US005433647A

United States Patent [19]

Ciquet

[11] Patent Number: 5,433,647

[45] Date of Patent: Jul. 18, 1995

[54] INVERTIBLE FOAM OBJECTS CAPABLE OF SEVERAL STABLE CONFIGURATIONS

[76] Inventor: Bernard Ciquet, Corniche André Tardieu, F-06500 Menton, France

[21] Appl. No.: 104,169

[22] PCT Filed: Feb. 13, 1992

[86] PCT No.: PCT/FR92/00144

§ 371 Date: Aug. 16, 1993

§ 102(e) Date: Aug. 16, 1993

[87] PCT Pub. No.: WO92/14528

PCT Pub. Date: Sep. 3, 1992

[30] Foreign Application Priority Data

Feb. 14, 1991 [FR] France ..... 91 01988

[51] Int. Cl.[6] ..... A63H 33/00

[52] U.S. Cl. ..... 446/486; 446/487

[58] Field of Search ..... 446/268, 320, 321, 486, 446/487, 491, 85; 273/155

[56] References Cited

U.S. PATENT DOCUMENTS

| | | | |
|---|---|---|---|
| 2,007,421 | 7/1935 | Coughlin | 446/488 |
| 3,302,321 | 2/1967 | Walker | 273/155 |
| 3,790,175 | 2/1974 | Ragnow | 446/124 |
| 3,811,682 | 5/1974 | Neale et al. | 446/488 |
| 3,894,352 | 7/1975 | Hooker | 446/488 |
| 3,916,559 | 11/1975 | Flowerday | 273/155 |
| 3,962,816 | 6/1976 | Sarid | 273/155 |
| 4,083,563 | 4/1978 | Drohomirecky et al. | 446/487 |
| 4,654,019 | 3/1987 | Waggener | 446/491 |
| 4,993,989 | 2/1991 | Gidwani | 446/487 |
| 5,046,988 | 9/1991 | Bennett | 446/487 |
| 5,090,938 | 2/1992 | Reynolds | 446/321 |
| 5,115,528 | 5/1992 | Lamle | 446/321 |

FOREIGN PATENT DOCUMENTS

| | | | |
|---|---|---|---|
| 2074459 | 11/1981 | United Kingdom | 273/155 |
| 9211911 | 7/1992 | WIPO | 273/155 |

OTHER PUBLICATIONS

Recreational Mathematics, vol. 2, No. 1, Jan. 1969 pp. 35–40, "Hybrid Flexahedrons."

Silly Sid, X-Potential, Inc. advertisement ©1973.

"Soft Fun-Foam Geo-Metric Shapes", Playthings, Mar. 1981, p. 115.

*Primary Examiner*—Robert A. Hafer

*Assistant Examiner*—Jeffrey D. Carlson

*Attorney, Agent, or Firm*—Young & Thompson

[57] ABSTRACT

The invention describes objects made from a soft, elastic (foam-like) material characterized by their topological structure which gives them remarkable transformability and makes them highly manipulable. They are defined by an outer shape (A) and an inner shape (B). Transformation is effected by completely turning the entity inside out. Following this manipulation, the initial inner form (B) determines the new form ($\overline{B}$) of the object and the initial outer form (A) is now reversed ($\overline{A}$) to become the inner form. The invention is aimed at the industrial manufacture of objects which may be individual objects or objects associated in sets of several geometric or figure forms which may have an aesthetic, leisure, didactic, ergotherapeutic or advertising application.

7 Claims, 2 Drawing Sheets

INVERTIBLE FOAM OBJECTS CAPABLE OF SEVERAL STABLE CONFIGURATIONS

FIELD OF THE INVENTION

This invention is concerned with convertible objects, made of foam or resilient and flexible materials or composites.

BACKGROUND OF THE INVENTION

The methods of working such materials (molding, cutting, thermoforming . . . ) are well-known and the invention is directed to the topologic structure of the shape of the manufactured products, which gives said products a remarkable transformability by means of an extremely easy manipulation.

GB-A-2 215 226 discloses a bag-like toy adapted to be reversed thereby to exhibit one or the other of its faces outside. Each face can have a desired shape.

The educational and play interest of such an object is limited to the arbitrary shapes of the bag-faces, because reversal of a bag is not amazing per se.

Moreover, GB-A-2 214 093 discloses a game made of cubes articulated to each other along coplanar axes, thereby to be rendered unloosable. This game has no particular effect with respect to volume variation.

SUMMARY OF THE INVENTION

The object of this invention is to provide a game allowing surprising changes of shape by mere manipulations.

According to the invention the object is transformable by manipulation between at least two intrinsically stable configurations in each of which a shape defines the outside of the object and a shape is inside the object. The transformation consists in completely reversing the object thereby to move inside the object at least part of the shape initially defining the outside and to move outside the object at least part of the other shape, by deformation of the material constituting the object, wherein the outer and inner shapes define blocks connected between them by non-coplanar narrower portions, and/or connected into a closed loop by narrower portions.

Thus, the stable configurations can be very different from each other, in a manner which is durably funny and surprising. The invention has an undeniable educational interest, it gives rise to inquisitiveness towards geometry and develops creativity in the field of plastic arts and sciences.

The structure can be made more complicated by associating a plurality of couples of shapes along different axes of reversal of the volume of the so defined object, whereby there are provided objects capable of being differently transformed depending upon the axis of the manipulation which has been performed.

This invention is intended to industrially make objects considered individually or associated as games, and the structure of which, depending upon its complexity, may combine several geometrical or figurative shapes, functional or not, and being remarkably particular, independently of the fact that the transformation is used for aesthetic, play, educational, occupational therapy, technical or advertising purposes:

DETAILED DESCRIPTION OF THE INVENTION

Figure 1A:
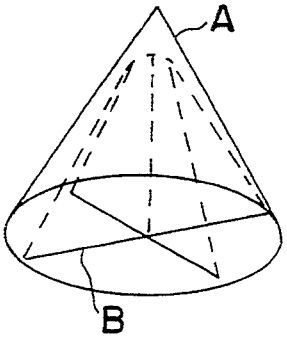
Figure 1B:
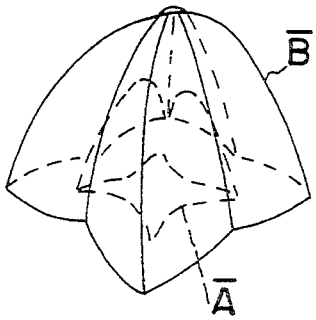

FIG. 1 shows an object according to the invention: the product, made of molded foam, is defined in a first configuration 1A by its outer shape (A) and its inner shape (B). After reversal, the configuration 1B is obtained, wherein the initially inner face (B) becomes the new outer face ($\overline{B}$) defining the new shape of the object and the initially visible face (A) is inverted into a new inner face ($\overline{A}$) inside the reversed volume.

Figure 2A:
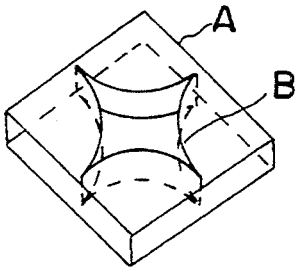
Figure 2B:
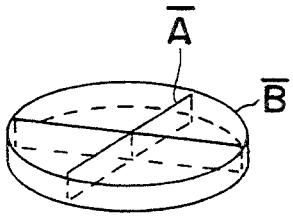
Figure 3A:
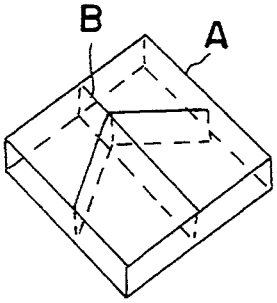
Figure 3B:
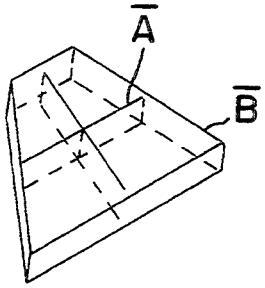
Figure 4A:
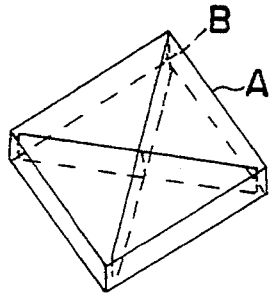
Figure 4B:
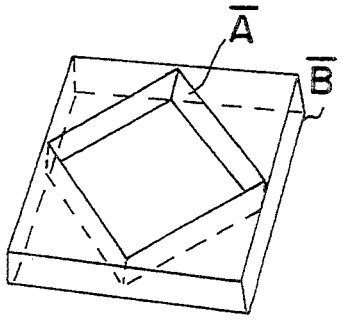

FIGS. 2, 3 and 4 show three objects according to the invention being cut out from a foam plate. In a first configuration 2A, 3A and 4A, respectively, they are defined by their outer profile (A) and their inner profile (B). After a reversal step, a second configuration 2B, 3B and 4B respectively is obtained, wherein the innerly cut profile (B) defines the new outer profile ($\overline{B}$) of the object and the initially outer profile (A) is inverted into an inner profile cutting ($\overline{A}$).

Figure 5:
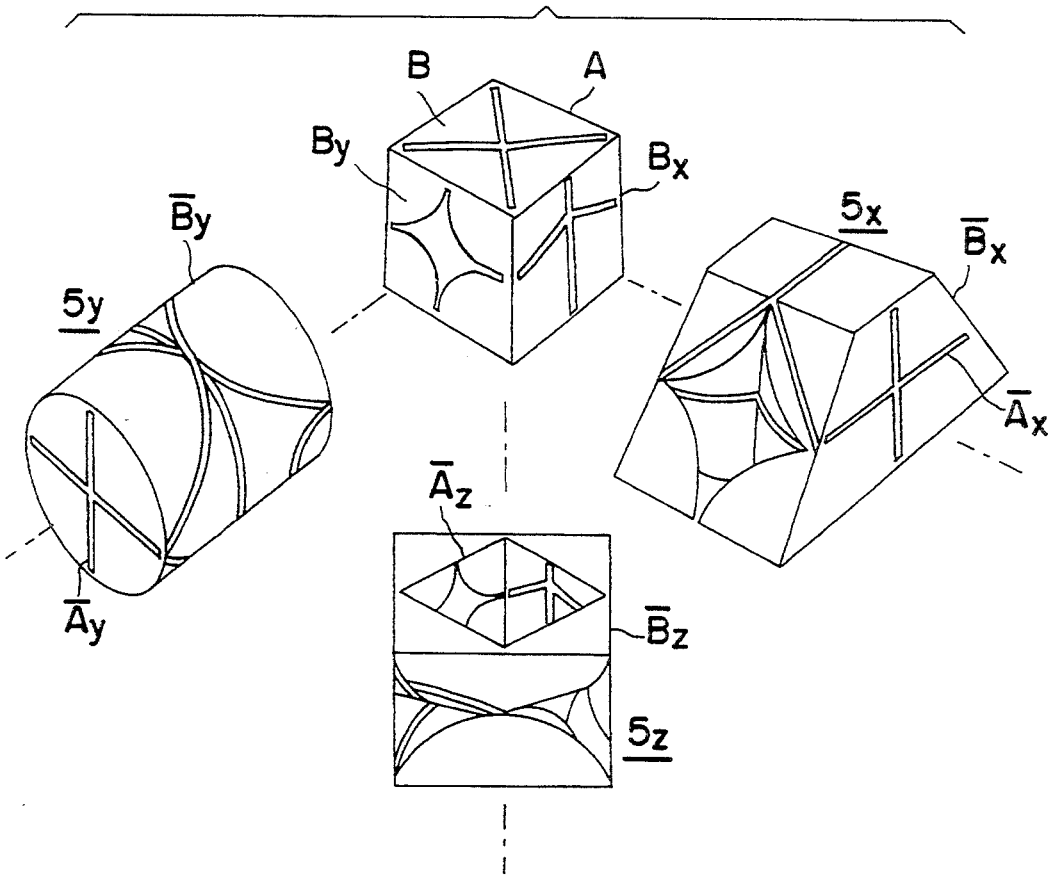

FIG. 5 shows an object according to the invention combining the three possibilities shown in FIGS. 2, 3 and 4 along three different reversal axes. The object is defined by its outer shape (A) and the inner profiles (Bx), (By), (Bz) as respectively seen along different axes of the volume shape of the object. After reversal following one of the axes the inner profile along the considered axis defines the new shape 5x or 5y or 5z of the reversed volume whereas the initial shape (A) is inverted inside into an inner profile ($\overline{A}$x) or ($\overline{A}$y) or respectively ($\overline{A}$z) as well as the inner faces along both other axes.

I claim:

1. An object transformable by manipulation, said object being made as a single piece of resilient foam material and having multiple faces defining blocks connected together by hinge portions, said object being transformed between at least two intrinsically stable configurations in each of which at least some of said faces define the outside of the object and other faces define the inside of the object, the transformation consisting in substantially reversing the object thereby to move inside the object at least part of the faces initially defining the outside and to move outside the object at least part of said other faces, by deformation of the resilient foam material constituting the object.

2. An object according to claim 1, wherein the hinge portions define hinge axes which are altogether noncoplanar.

3. An object according to claim 1, wherein said blocks are connected into a closed loop by said hinge portions.

4. An object according to claim 1, capable of at least three intrinsically stable configurations, wherein said multiple faces define in at least one of said at least three configurations, a first outer profile and a first inner profile when transformation is made along a first axis, and a second outer profile and a second in profile when the transformations made along a second axis extending at an angle with respect to said first axis.

5. An object according to claim 1, which is generally plate-shaped in at least one of the configurations.

6. An object according to claim 1, which is generally plate-shaped in said at least two configurations.

7. An object according to claim 1, capable of at least three intrinsically stable configurations and allowing movement from one configuration to another by reversal following different axes.

* * * * *